US012252753B2

(12) United States Patent
Reinhardt et al.

(10) Patent No.: US 12,252,753 B2
(45) Date of Patent: Mar. 18, 2025

(54) SYSTEMS AND METHODS FOR SELF-REDUCTION OF IRON ORE

(71) Applicant: Charm Industrial, Inc., San Francisco, CA (US)

(72) Inventors: Peter Reinhardt, San Francisco, CA (US); Brian Jamieson, Brighton, CO (US)

(73) Assignee: Charm Industrial, Inc., San Francisco, CA (US)

( * ) Notice: Subject to any disclaimer, the term of this patent is extended or adjusted under 35 U.S.C. 154(b) by 0 days.

(21) Appl. No.: 18/409,428

(22) Filed: Jan. 10, 2024

(65) Prior Publication Data

US 2024/0229176 A1 Jul. 11, 2024

Related U.S. Application Data

(60) Provisional application No. 63/514,472, filed on Jul. 19, 2023, provisional application No. 63/438,427, filed on Jan. 11, 2023.

(51) Int. Cl.
*C21C 7/00* (2006.01)

(52) U.S. Cl.
CPC .... *C21C 7/0025* (2013.01); *C21C 2007/0031* (2013.01); *C21C 2100/02* (2013.01)

(58) Field of Classification Search
CPC ..... C21C 7/0025; C21C 2007/0031; C21C 2100/02; C21B 2100/282; C21B 2100/66;
(Continued)

(56) References Cited

U.S. PATENT DOCUMENTS 5,078,788 A 1/1992 Bueno et al.
7,198,658 B2 4/2007 Sugitatsu et al.
(Continued)

FOREIGN PATENT DOCUMENTS

CN 101538627 A 9/2009
GB 2014604 A 8/1979
(Continued)

OTHER PUBLICATIONS

JPS61183402A Translation (Year: 1986).*
(Continued)

*Primary Examiner* — Brian D Walck
*Assistant Examiner* — Danielle Carda
(74) *Attorney, Agent, or Firm* — Goodwin Procter LLP

(57) ABSTRACT

Disclosed herein, in some aspects, are systems and methods for producing a material comprising iron through self-reduction of iron ore using bio-oil and/or other reducing agents (e.g., bio-based reducing agents), such as biocrude, ethanol, or other bio-based liquids or biologically sourced liquids. The bio-oil and/or other reducing agents can be mixed with the iron ore to form a furnace mixture, which can be heated, such that the components of the bio-oil and/or other reducing agents in the furnace mixture reduce the iron ore to form an iron product (e.g., a material that includes metallic iron). In some cases, the pre-formed furnace mixture allows for the reducing agents to interact with the iron more readily, thereby providing for quicker reaction rates, and thereby quicker reduction of iron ore, as compared to direct reduction iron production.

30 Claims, 10 Drawing Sheets

(58) Field of Classification Search
CPC ..... C21B 13/006; C21B 13/0066; C21B 13/0073; C21B 13/008; C21B 13/004; C21B 5/10; C21B 5/12
USPC ..... 75/359
See application file for complete search history.

(56) References Cited

U.S. PATENT DOCUMENTS

| | | | |
|---|---|---|---|
| 7,931,731 | B2 | 4/2011 | Van Heeringen et al. |
| 8,753,422 | B2 | 6/2014 | Gharda |
| 8,764,875 | B2 | 7/2014 | Huang et al. |
| 8,906,131 | B2 | 12/2014 | Simmons |
| 9,238,598 | B2 | 1/2016 | Hammad et al. |
| 9,840,445 | B2 | 12/2017 | Winter et al. |
| 10,093,996 | B2 | 10/2018 | Winter et al. |
| 11,591,662 | B2 | 2/2023 | Castagnola et al. |
| 2008/0311010 | A1 | 12/2008 | Boe |
| 2020/0191481 | A1 | 6/2020 | Cox et al. |
| 2021/0261877 | A1 | 8/2021 | Despen et al. |
| 2021/0348076 | A1 | 11/2021 | Despen et al. |
| 2021/0355398 | A1 | 11/2021 | Despen et al. |
| 2021/0380406 | A1 | 12/2021 | Zhou et al. |
| 2022/0098700 | A1 | 3/2022 | Mennell et al. |
| 2022/0162077 | A1 | 5/2022 | Mennell et al. |
| 2022/0162725 | A1 | 5/2022 | Mennell et al. |
| 2022/0162726 | A1 | 5/2022 | Mennell et al. |
| 2023/0160028 | A1 | 5/2023 | Hyllander et al. |

FOREIGN PATENT DOCUMENTS

| | | | | | |
|---|---|---|---|---|---|
| JP | S61183402 | A * | 8/1986 | ..... | B22F 8/20 |
| JP | 7128892 | B2 | 8/2022 | | |
| WO | WO-2009007007 | A1 | 1/2009 | | |
| WO | WO-2014040989 | A2 | 3/2014 | | |
| WO | WO-2015035969 | A2 | 3/2015 | | |
| WO | WO-2021037700 | A1 * | 3/2021 | ..... | B01D 53/60 |
| WO | WO-2021214167 | A1 * | 10/2021 | ..... | C21B 13/0066 |
| WO | WO-2022023187 | A1 | 2/2022 | | |
| WO | WO-2022061398 | A1 | 3/2022 | | |
| WO | WO-2022104443 | A1 | 5/2022 | | |
| WO | WO-2022109663 | A1 | 6/2022 | | |
| WO | WO-2022159022 | A1 | 7/2022 | | |
| WO | WO-2022233769 | A1 | 11/2022 | | |
| WO | WO-2022264904 | A1 | 12/2022 | | |
| WO | WO-2023043358 | A1 | 3/2023 | | |
| WO | WO-2023052308 | A1 | 4/2023 | | |
| WO | WO-2023066794 | A1 | 4/2023 | | |

OTHER PUBLICATIONS

Gordon, Katie, The Assay Guide to Iron Ore, The Assay, 2023 (Year: 2023).*

US Department of Agriculture, "Bio-oil" (Year: 2017).*

U.S. Appl. No. 18/503,036, filed Nov. 6, 2023, Systems and Methods for Producing Syngas From Bio-Oil.

Rierson, D. and Albert, A., "Development of the ACCAR Process at Allis-Chalmers," Ironmaking Proceedings, 1977:455-467.

Lepinski, James, "The ACCAR system and its application to direct reduction of iron ores," Iron and Steel Engineer, Dec. 1980, 57(12) (9 pages).

Hwang, Jae Gyu, et al., "Quality improvement and tar reduction of syngas produced by bio-oil gasification," Energy, vol. 236, Jul. 13, 2021, 10 pages.

International Search Report and Written Opinion for International Patent Application No. PCT/US2023/036887, dated Mar. 1, 2024, 14 pages.

International Search Report and Written Opinion for International Patent Application No. PCT/US2024/011091, dated Mar. 27, 2024, 15 pages.

Zheng, Ji-Lu, et al., "Bio-oil gasification using air—Steam as gasifying agents in an entrained flow gasifier," Energy, vol. 142, Oct. 9, 2017 (Oct. 9, 2017), pp. 426-435.

* cited by examiner

SYSTEMS AND METHODS FOR SELF-REDUCTION OF IRON ORE

CROSS-REFERENCE

This application claims the benefit of and priority to U.S. Provisional Patent Application No. 63/438,427, titled "Systems and Methods for Producing Iron Using Bio-Oil Based Self-Reduction," and filed on Jan. 11, 2023, and U.S. Provisional Patent Application No. 63/514,472, titled "Systems and Methods for Self-Reduction of Iron Ore," and filed on Jul. 19, 2023, each of which is incorporated herein by reference in its entirety.

BACKGROUND

Iron ore is traditionally reduced in blast furnaces or direct reduction furnaces where particles of the iron ore, provided as lumps and/or pellets, are contacted with a gas containing a reducing agent, such as carbon monoxide or hydrogen. The reducing agent strips oxygen atoms off iron oxide in the iron ore, to produce metallic iron. Such reduction processes can be slow due to a need for gases to diffuse in and out of the iron ore particles. As a result, traditional blast furnaces or direct reduction furnaces can be tall to achieve sufficient residence times.

The foregoing discussion, including the description of motivations for some embodiments of the invention, is intended to assist the reader in understanding the present disclosure, is not admitted to be prior art, and does not in any way limit the scope of any of the claims.

SUMMARY

Disclosed herein, in some aspects, is a process for producing a material comprising iron, the process comprising: providing iron ore feedstock comprising iron oxide; mixing a bio-based liquid reducing agent with the iron ore feedstock to form a mixture; and heating the mixture to reduce the iron oxide and produce the material comprising iron.

In some embodiments, the mixture is heated to at least about 700° C., at least about 900° C., at least about 1000° C., at least about 1300° C., or at least about 1500° C. In some embodiments, the mixture comprises a bio-based liquid reducing agent to iron mass ratio from about 0.5:1 to about 1.5:1. In some embodiments, the bio-based liquid reducing agent comprises one or more of bio-oil, glycerol, biodiesel, ethanol, other alcohols, used cooking oils, vegetable oil, plant-based oils, solutions containing microbes or algae, biocrude, or biocrude byproducts. In some embodiments, the bio-based liquid reducing agent comprises bio-oil. In some embodiments, the bio-oil comprises a liquid formed at least partially from one or more of agricultural crops, algal biomass, municipal wastes, and agriculture and forestry by-products.

In some embodiments, the material comprising iron comprises one or more of pure iron, direct reduced iron, hot briquetted iron, pig iron, molten iron, hot metal, sponge iron, or an iron rich metal. In some embodiments, the iron oxide comprises one or more of hematite, magnetite, or wustite. In some embodiments, the iron ore feedstock comprises iron ore particle sizes from about 0.1 mm to about 1 cm. In some embodiments, the produced material comprising iron comprises from about 70% to about 100% metallization of iron from the iron oxide. In some embodiments, mixing the bio-based liquid reducing agent with the iron ore feedstock comprises using a mixing unit. In some embodiments, the mixing unit comprises a shaft and one or more blades at a distal portion thereof, and wherein the one or more blades are configured to rotate about a longitudinal axis of the shaft. In some embodiments, the mixture is mixed outside a furnace (e.g., reactor) configured to heat the mixture, as described herein. In some embodiments, the mixture is mixed within a furnace (e.g., reactor) configured to heat the mixture, as described herein.

In some embodiments, heating the mixture comprises using a furnace. In some embodiments, the mixing and the heating are performed in a common enclosure. In some embodiments, the mixture comprises a liquid, substantially liquid, or a slurry form. In some embodiments, the process further comprises adding flux to the mixture to help separate one or more impurities therefrom. In some embodiments, the flux is alkaline or comprises alkaline components that bond with one or more of acidic sulfur or silicate components. In some embodiments, the one or more impurities comprise one or more of sulfur or silicate components.

In some embodiments, the process further comprises using volatile gases released from heating the mixture as a heat source. In some embodiments, the process further comprises capturing and/or sequestering carbon dioxide produced from heating the mixture. In some embodiments, heating the mixture comprises i) heating the mixture in a volatilization furnace to release volatile gases, thereby producing a second mixture, and ii) heating the second mixture in a reduction furnace to produce the material comprising iron. In some embodiments, at least some of the released volatile gases are provided as a heat input to the reduction furnace. In some embodiments, the process is a batch process or a continuous process. In some embodiments, the iron ore feedstock comprises at least one of iron ore fines or iron ore concentrate.

Disclosed herein, in other aspects, is a system for producing a material comprising iron, the system comprising: a mixing unit configured to mix a bio-based liquid reducing agent and iron ore feedstock to form a mixture, the iron ore feedstock comprising iron oxide; and a furnace configured to heat the mixture to reduce the iron oxide and form the material comprising iron.

In some embodiments, the furnace is configured to heat the mixture to at least about 700° C., at least about 900° C., at least about 1000° C., at least about 1300° C., or at least about 1500° C. In some embodiments, the mixing unit is in fluid communication with the furnace, to enable the mixture to be transferred from the mixing unit to the furnace. In some embodiments, the mixing unit is disposed within the furnace, to mix the bio-based liquid reducing agent and iron ore feedstock therein. In some embodiments, the mixing unit comprises a shaft and one or more blades at a distal portion thereof, and wherein the one or more blades are configured to rotate about a longitudinal axis of the shaft. In some embodiments, the shaft is operatively coupled to a motor configured to rotate the shaft.

In some embodiments, the system is further configured to use volatile gases released from heating the mixture as a heat input to the furnace. In some embodiments, the system further comprises one or more of an amine-based carbon capture system, pressure swing adsorption system, vacuum swing adsorption system, temperature swing adsorption system, gas separation membranes, or polymeric membranes, to capture and/or sequester carbon dioxide. In some embodiments, the furnace comprises a volatilization furnace and a reduction furnace, the volatilization furnace configured to heat the mixture to release volatile gases and form a second mixture, the reduction furnace configured to receive and heat the second mixture to produce the material comprising iron. In some embodiments, the system is further configured to provide at least some of the released volatile gases as heat input to the reduction furnace. In some embodiments, the system is further configured to provide at least some of the flue gas produced in the reduction furnace to the volatilization furnace as heat input.

In some embodiments, the bio-based liquid reducing agent comprises one or more of bio-oil, glycerol, biodiesel, ethanol, other alcohols, used cooking oils, vegetable oil, plant-based oils, solutions containing microbes or algae, biocrude, or biocrude byproducts. In some embodiments, the bio-based liquid reducing agent comprises bio-oil. In some embodiments, the bio-oil comprises a liquid formed at least partially from one or more or agricultural crops, algal biomass, municipal wastes, and agriculture and forestry by-products.

In some embodiments, the material comprising iron comprises one or more of pure iron, direct reduced iron, hot briquetted iron, pig iron, molten iron, hot metal, sponge iron, or an iron rich metal. In some embodiments, the iron oxide comprises one or more of hematite, magnetite, or wustite. In some embodiments, the iron ore feedstock comprises iron ore particle sizes from about 0.1 mm to about 1 cm. In some embodiments, the produced material comprising iron comprises from about 70% to about 100% metallization of iron from the iron oxide. In some embodiments, the mixture comprises a liquid, substantially liquid, or a slurry form. In some embodiments, the iron ore feedstock comprises at least one of iron ore fines or iron ore concentrate.

BRIEF DESCRIPTION OF THE DRAWINGS

These and other features, aspects, and advantages of some embodiments will become better understood with regard to the following description and accompanying drawings.

DETAILED DESCRIPTION

I. Definitions

Figure 1:
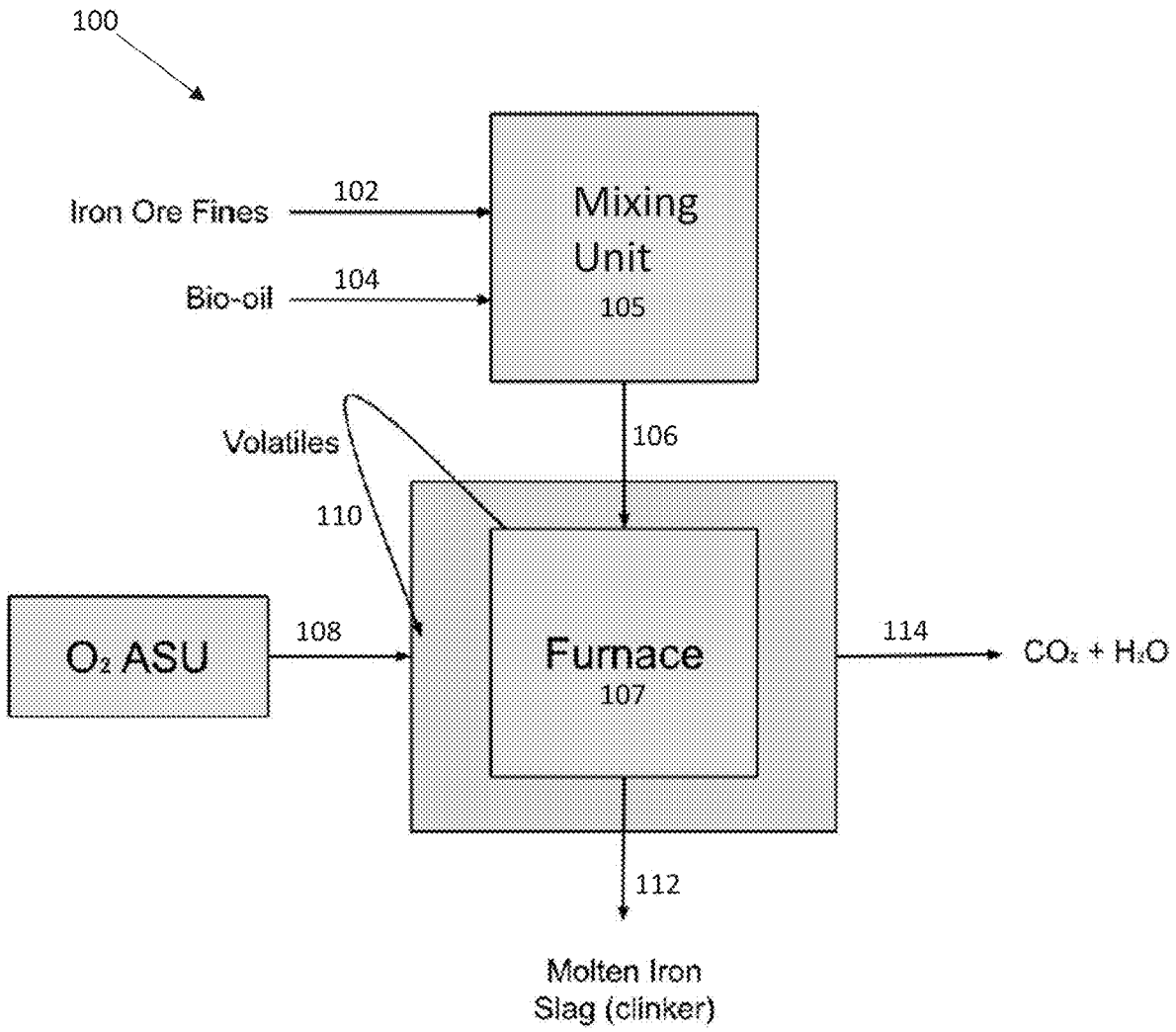
FIG. 1 depicts a flow diagram for an exemplary process for producing iron through self-reduction using bio-oil, according to an embodiment disclosed herein.

Terms used in the claims and specification are defined as set forth below unless otherwise specified.

The phrase "and/or," as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements).

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used shall only be interpreted as indicating exclusive alternatives (i.e., "one or the other but not both") when preceded by terms of exclusivity, such as "either," "one of," "only one of," or "exactly one of."

II. Iron Production Using Self-Reduction

In some cases, for traditional blast and direct reduction furnaces, iron ore is provided in natural lumps, sintered lumps, or agglomerated pellets, wherein these lumps/pellets are contacted with approximately 800° C. to 2200° C. reducing gas including primarily carbon monoxide and hydrogen. Using such traditional direct iron ore reduction, the reducing agent (e.g., carbon monoxide (CO) or hydrogen ($H_2$)) may need to flow through tiny pores into the lumps, strip an oxygen atom off the iron oxide, and then the resulting carbon dioxide ($CO_2$) or water vapor ($H_2O$) may need to flow back out through the tiny pores to get out of the flue stack. Accordingly, in some cases, such reduction processes can be slow because the pores are tiny and the gas(es) (e.g., $CO_2/H_2O$ and/or $CO/H_2$) needs to diffuse in both directions. Accordingly, in some cases, a longer residence time may be required at the blast or reduction furnace, which may require such furnaces to be tall. In some examples, a tall furnace may cause the ore and/or carbon materials (e.g., reducing agents) to be subjected to large mechanical stresses, which can, for example, compress the ore and/or cause ore particles to crumble or collapse.

By contrast, systems and methods described herein include iron production using self-reduction, wherein iron ore (e.g., iron ore fines, iron ore concentrate, and other iron oxide bearing feedstocks, such as mine tailings and/or other traditional wastes) is combined with a reducing agent, e.g., bio-oil, biocrude, etc., so as to form a mixture of the reducing agent and the oxidizing agent (e.g., iron bearing oxide). For example, iron ore feedstock mixed with bio-oil or biocrude (as described herein) may form a slurry mixture. In some embodiments, heating said mixture at high enough temperature allows for iron ore reduction to metallic iron to occur. For example, in some cases, after applying heat to reach a temperature of about 700° C. to 1500° C., the reaction can proceed rapidly, because the reactants are proximate already, and the produced $CO_2$ gas only has to travel away from the reaction. In some instances, for example, the use of iron ore feedstock (small particles) makes it easier for gases (e.g., CO and $CO_2$) to enter and exit interior portions of the iron ore. Compared to larger iron ore pellets, for example, the gases do not need to migrate or travel as far to reach iron oxide in interior portions of the particles. This can significantly increase reaction rates and reduce reaction times.

Accordingly, in some embodiments, ironmaking via self-reduction proceeds 10-20× faster than ironmaking in a normal blast furnace. Moreover, accordingly, in some embodiments, the furnace for reducing the iron ore can be 10-20× smaller (e.g., shorter) for the same iron production rate. In some instances, for example, once the reaction materials (e.g., iron ore feedstock and bio-oil) have been preheated to a desired reaction temperature (e.g., greater than or equal to about 900)° C., the self-reduction reaction can be completed within about 10 to 45 minutes (e.g., about 20 minutes) using the techniques described herein. The time to preheat the reaction materials can range from about 20 minutes to about 100 minutes or longer, depending on the volume or mass of the reaction materials and the rate at which heat is applied.

In some embodiments, the use of bio-oil as opposed to, for example, coal fines yields surprising and unexpected results relating to iron ore reduction. For example, although bio-oil does include elemental carbon, bio-oil also includes other elements like hydrogen and oxygen bound covalently to carbon to form complex components (e.g., acetic acid, etc.) that are chemically very different from elemental carbon and further has a relatively low energy content (e.g., compared to coal). Nonetheless, in some cases, self-reduction of iron ore using bio-oil achieves from approximately at least 70% to nearly 100% metallization in the produced iron. As used herein, the metallization in the produced iron refers to the amount (e.g., percentage) of iron mass in the product that is metallic iron rather than iron bound to oxygen. Such estimation of the metallization may be confirmed using laboratory analysis.

Moreover, in some embodiments, bio-oil is provided as a liquid, such that the resulting mixture with iron ore feedstock is a liquid, or a slurry, which may be easier to create, transport and transfer than solid briquettes (e.g., obtained via mixing iron ore and carbon fines).

III. System Environment Overview

Described herein, in some embodiments, are systems and methods for producing a material comprising iron through self-reduction of iron ore using bio-oil and/or other reducing agents (e.g., bio-based reducing agents), such as biocrude, ethanol, or other bio-based liquids or biologically sourced liquids. Such liquids can be derived at least in part from materials of biological origin and/or can exclude liquids embedded in or extracted from geological formations, such as underground wells. In some cases, the material comprising iron comprises pure iron, direct reduced iron, hot briquetted iron, pig iron, molten iron, hot metal, sponge iron, an iron rich metal, other metallic iron containing substances, or any combination thereof. In some embodiments, the bio-oil and/or other reducing agents are mixed with the iron ore to form a furnace mixture. In some embodiments, the furnace mixture is heated, such that the components of the bio-oil and/or other reducing agents in the furnace mixture reduce the iron ore to form an iron product (e.g., a material that includes metallic iron). In some cases, the pre-formed furnace mixture allows for the reducing agents to interact with the iron more readily, thereby providing for quicker reaction rates, and thereby quicker reduction of iron ore, as compared to direct reduction iron production (as described herein). In some embodiments, the furnace mixture can be formed outside the furnace and/or within the furnace.

In some embodiments, use of bio-oil and/or other bio-based reducing agents for self-reduction of iron ore can achieve a reduction in global emissions as opposed to iron ore produced via traditional methods (e.g., using only fossil fuels such as natural gas, coal, and coke). In some embodiments, such global emission reduction includes reduction in carbon dioxide ($CO_2$) emissions. In some embodiments, such reduction in carbon dioxide emissions is based on bio-oil being produced using biomass. In some embodiments, producing the material comprising iron, as described herein (e.g., iron metallics, molten iron, etc.) using bio-oil and/or other reducing agents, as described herein, can reduce global emissions (e.g., carbon dioxide emissions) by at least about 1%, 5%, 10%, 15%, 20%, 25%, 30%, 40%, or 50%.

FIG. 1 depicts an exemplary process 100 for producing molten iron through self-reduction using bio-oil. As described herein, in some embodiments, the iron ore 102 is mixed with the bio-oil 104 in a mixing unit 105 to form a mixture 106. As used herein, the feed stream bio-oil (104) refers to bio-oil and/or other reducing agents, as described herein. In some embodiments, the iron ore 102 includes iron ore feedstock, which may include iron ore fines and/or iron ore concentrate. In some embodiments, the iron ore fines have a size (e.g., particle diameter) ranging from about 0.1 mm to about 1 mm, or to about 1 cm. In some embodiments, the iron ore concentrate is in the form of a fine powder, which may include particle sizes less than about 0.15 mm, such as a maximum particle size of about 0.11 mm.

As described herein, in some cases, bio-oil 104 can be obtained via biomass. In some cases, bio-oil corresponds to a liquid product made from biomass materials, which may include, for example, agricultural crops, algal biomass, municipal wastes, and/or agricultural and forestry by-products. In some embodiments, as described herein, the bio-oil is produced via biomass, using any method as known in the art. In some embodiments, bio-oil is produced from biomass via one or more thermo-chemical processes. For example, in some embodiments, bio-oil is produced via flash pyrolysis (see Example 4 herein), hydrothermal liquefaction (see Example 4 herein), or other processes known in the art. Accordingly, in some embodiments, the bio-oil is mixed with the iron ore feedstock (e.g., iron ore fines and/or iron ore concentrate) in liquid form. In some embodiments, the bio-oil includes from about 20 wt % (weight percent) to about 70 wt % carbon, from about 3 wt % to about 15 wt % hydrogen, nitrogen less than approximately 5%, with oxygen making up the majority of the remaining chemical mass balance. In some embodiments, the bio-oil includes a water content, for example, resulting from water found in the biomass material. In some embodiments, the water in bio-oil is obtained via condensation of water droplets in air, that the biomass materials and/or bio-oil are exposed to. In some embodiments, water is added to the bio-oil to boost the water content. In some embodiments, the ratio of mass flow rate of bio-oil to water mass flow rate in the bio-oil 104 can be, for example, from about 1:2 to about 10:1, or higher.

In some embodiments, other materials, which may be reducing agents, are used in addition to or instead of bio-oil. For example, in some embodiments, stream 104 includes bio-oil and/or other carbon-containing liquids, such as for example, glycerol, biodiesel, ethanol, other alcohols, used cooking oils, vegetable oil, plant-based oils, solutions containing microbes or algae, biocrude, biocrude byproducts, dispersions of biomass particles and/or biochar particles in water or other liquid, and/or fuels such as petroleum, crude oil, gasoline, kerosene, or diesel. In some embodiments, the carbon-containing liquids described herein are liquid at or around atmospheric pressure and/or at temperatures ranging from about −20° C. to about 50° C., more typically from about 10° C. to about 25° C.

In various examples, a wide variety of biomass sources can be used to produce the carbon-containing liquids described herein. The biomass sources can be or include, for example, waste sawdust (e.g., that would otherwise rot) and/or waste agricultural residue (e.g., from an immediate vicinity of a fast pyrolysis plant). In the United States, corn stover (e.g., corn leaves, stalks, and cobs) is an example of a large-scale agricultural waste product that has little value. Rice straw and sugar cane bagasse are similarly low-value waste products in other countries. Such waste products are commonly burned in the field, allowed to rot, or can be used as animal bedding. These three crops alone yield 1.7 gigatons per year of waste biomass, with rice straw at 580 metric megatons per year (e.g., 3.7 tons/ha over 158 million ha), bagasse at 300 metric megatons per year, and corn stover at 860 metric megatons per year (e.g., 43 billion bushels at 2 tons recoverable/100 bushels).

A variety of other biomass sources or waste materials can be used to generate the carbon-containing liquids described herein. For example, the biomass source can be or include materials from forest thinning or powerline maintenance operations. Additionally or alternatively, certain chemical processes may use only a portion of the biomass in their specific processes and can end up with less useful byproducts that can be used as biomass sources. For example, paper mills produce a lignin pulp that can be used as a biomass source. In another example, STORA ENSO, a Louisiana company, utilizes a process that takes in raw sugarcane bagasse and produces a cooked bagasse byproduct that can be used as a biomass source that is rich in cellulose and lignin but void of hemicellulose.

Another option for the biomass source or feedstock is to plant or procure biomass used for remediation of soil (e.g., at U.S. Superfund sites) that may be high in heavily regulated toxic metals.

Examples 5-7 herein describe additional exemplary processes for producing carbon-containing liquids, which can be used as reducing agents.

In some embodiments, the bio-oil is stored for use in iron production. For example, in some cases bio-oil is stored in a container, tank, or other enclosure. In some embodiments, the bio-oil storage means (e.g., container, tank, etc.) is in fluid communication with the mixing unit 105. In some embodiments, the bio-oil is configured to be transferred to the mixing unit 105 via a pump. In some embodiments, one or more pumps in series and/or parallel are configured to deliver the bio-oil to the mixing unit 105 from the storage means.

With reference to FIG. 1, in some embodiments, the bio-oil 104 and iron ore feedstock 102 are fed to the mixing unit 105 for mixing therein. In some embodiments, the mixing unit 105 includes a vessel, container, or other storage apparatus configured to receive both the iron ore feedstock and bio-oil. In some embodiments, the mixing unit 105 includes a mixing apparatus configured to mix the iron ore feedstock and bio-oil so as to form the furnace mixture 106. In some embodiments, the mixing apparatus includes a shaft and one or more blades located about a distal portion of the shaft, wherein the one or more blades are configured to rotate about a longitudinal axis of the shaft while contacting the iron ore feedstock and bio-oil. In some embodiments, the shaft is operatively coupled to a motor configured to rotate said shaft about the longitudinal axis. In some embodiments, any other known mixing method in the art can be used to mix the bio-oil and iron ore feedstock.

In some embodiments, the furnace mixture 106 includes a bio-oil to iron ore feedstock mass ratio from about 0.1:2 to about 2:0.1, from about 0.5:1.5 to about 1.5:0.5, or from about 0.75:1.25 to about 1.25:0.75. In some embodiments, the furnace mixture 106 is liquid or substantially liquid. In some embodiments, the furnace mixture 106 is a slurry or substantially a slurry (e.g., with the iron ore feedstock dispersed within the bio-oil).

In some embodiments, the furnace mixture 106 is fed to a furnace 107 from the mixing unit 105. In some embodiments, the furnace mixture is formed within the furnace (e.g., the iron ore feedstock are fed to the furnace separately from the bio-oil and/or other reducing agents, and mixed within the furnace). In some embodiments, the furnace mixture 106 is heated within the furnace 107 to drive the self-reduction of the iron ore. In some embodiments, the furnace mixture 106 and/or other materials or components in the furnace 107 are heated to a temperature from about 500° C. to about 2500° C., from about 900° C. to about 2000° C., or from about 1300° C. to about 1500° C. In some cases, temperatures of 900° C. or higher may achieve higher or optimal self-reduction reaction rates. In some embodiments, the furnace mixture 106 is heated via burning of the bio-oil that is part of the furnace mixture. In some embodiments, oxygen 108 is provided to help at least partially burn said bio-oil. Additionally or alternatively, other fuel or heat sources may be provided to the furnace 107 to heat the furnace mixture 106.

In some embodiments, the bio-oil includes a high volatile content and produces volatile gas(es) as the furnace mixture 106 is heated. In some cases, the volatile gases provide additional heat to the furnace (e.g., by acting as an additional fuel source to be burned). Accordingly, in some cases, the need for additional fuel sources and oxygen can be reduced as the heat generated by the furnace mixture may be self-generated and self-sustainable. In some embodiments, all or substantially all of the volatile gases released from heating the furnace mixture are burned. In some embodiments, volatile gases that are not burned and exit the furnace are captured and recycled 110 back to the furnace 107 to recapture said additional heat source.

In some embodiments, the furnace mixture 106 is fed to the top of the furnace 107, where the temperature of the furnace mixture increases as it moves towards the bottom of the furnace. In some embodiments, flux is added to the furnace 107 to separate impurities, e.g., sulfur, silicates, that may be found in the iron ore and potentially bio-oil. In some cases, the flux is alkaline and/or includes alkaline components that bond with the acidic sulfur and silicate components, so as to lower their melting temperature and become separable as slag. In some embodiments, the flux includes limestone. In some embodiments, when bio-oil and/or other reducing agents have high acidity, the flux can be added to the furnace after the acidic volatiles have been vaporized.

In some cases, producing iron from iron ore includes the following transition(s): $Fe_2O_3$ ("hematite")→$Fe_3O_4$ ("magnetite"), $Fe_3O_4$→FeO ("wustite")→Fe. Overall, this route can be simplified as $Fe_2O_3$→Fe. Declaration of these feedstock minerals does not eliminate other potential iron sources, one example being FeO(OH). Specifically in some cases, the reducing agent will remove oxygen from the $Fe_2O_3$ to produce Fe+$CO_2$+$H_2O$, wherein the $CO_2$+$H_2O$ may exit 114 the furnace 107. In some embodiments, the iron ore is reduced above the melting point of the metallic iron/ore, and produces a liquid flow of hot metal (e.g., molten iron and slag 112). In some cases, steel is produced via iron (e.g., Fe→steel alloys). For example, in some cases, the liquid flow of hot metal flows into a Basic Oxygen Furnace for steelmaking (removing carbon and mixing with scrap, charging to secondary steelmaking processes where alloying elements are added, etc.). In some cases, hot metal can be charged to electric arc furnaces or electric smelting furnaces for further processing to steel.

In some embodiments, flux is not added to the furnace. In some embodiments, instead of molten iron slag being produced at stream 112, direct reduced iron is produced (e.g., solid iron product, direct reduced sponge iron, etc.).

In some embodiments, the furnace 107 is direct fired, thereby producing direct reduced iron (e.g., solid iron product, direct reduced sponge iron, etc.) instead of molten iron slag.

In some cases, producing iron from iron ore includes the following transition(s): $Fe_2O_3$ ("hematite")→$Fe_3O_4$ ("magnetite"), $Fe_3O_4$→FeO ("wustite")→Fe. Overall, this route can be simplified as $Fe_2O_3$→Fe. Specifically in some cases, the reducing agent will remove oxygen from the $Fe_2O_3$ to produce Fe+$CO_2$+$H_2O$, wherein the $CO_2$+$H_2O$ may exit 114 the furnace 107. In some cases, hematite ore can be preferable over other types of ore, such as magnetite ore, due to the increased porous structure of hematite ore, which can allow for a more rapid reduction. In some embodiments, the iron ore is reduced below the melting point of the metallic iron/orc, and solid metallic iron is produced from the fines. In some cases, this metallic iron is magnetically separated from the non-ferrous oxides to increase the iron content of the iron metallic. In some cases, the separated iron material/sponge is briquetted. Briquetted or non-briquetted iron can be used in steelmaking or other ironmaking processes as an iron unit.

In some embodiments, any of the processes described herein for producing a material comprising iron can further include capturing and/or sequestering $CO_2$. For example, in some cases, exhaust gas produced (e.g., see stream 114 in FIG. 1, stream 214 in FIG. 2) via the furnace (e.g., 107, 207) includes $CO_2$ that can be captured and stored. In some embodiments, one or more types of $CO_2$ capture techniques can be used with a process described herein, including, for example: amine-based carbon capture systems, pressure swing adsorption, vacuum swing adsorption, temperature swing adsorption, gas separation membranes, polymeric membranes, and/or any other process known in the art. In some embodiments, the captured $CO_2$ is sequestered underground, such as, for example, in saline formations, oil and natural gas reservoirs, unmineable coal seams, organic-rich shales, and/or basalt formations. In some cases, the captured $CO_2$ is compressed into a supercritical fluid for storage underground.

Figure 2:
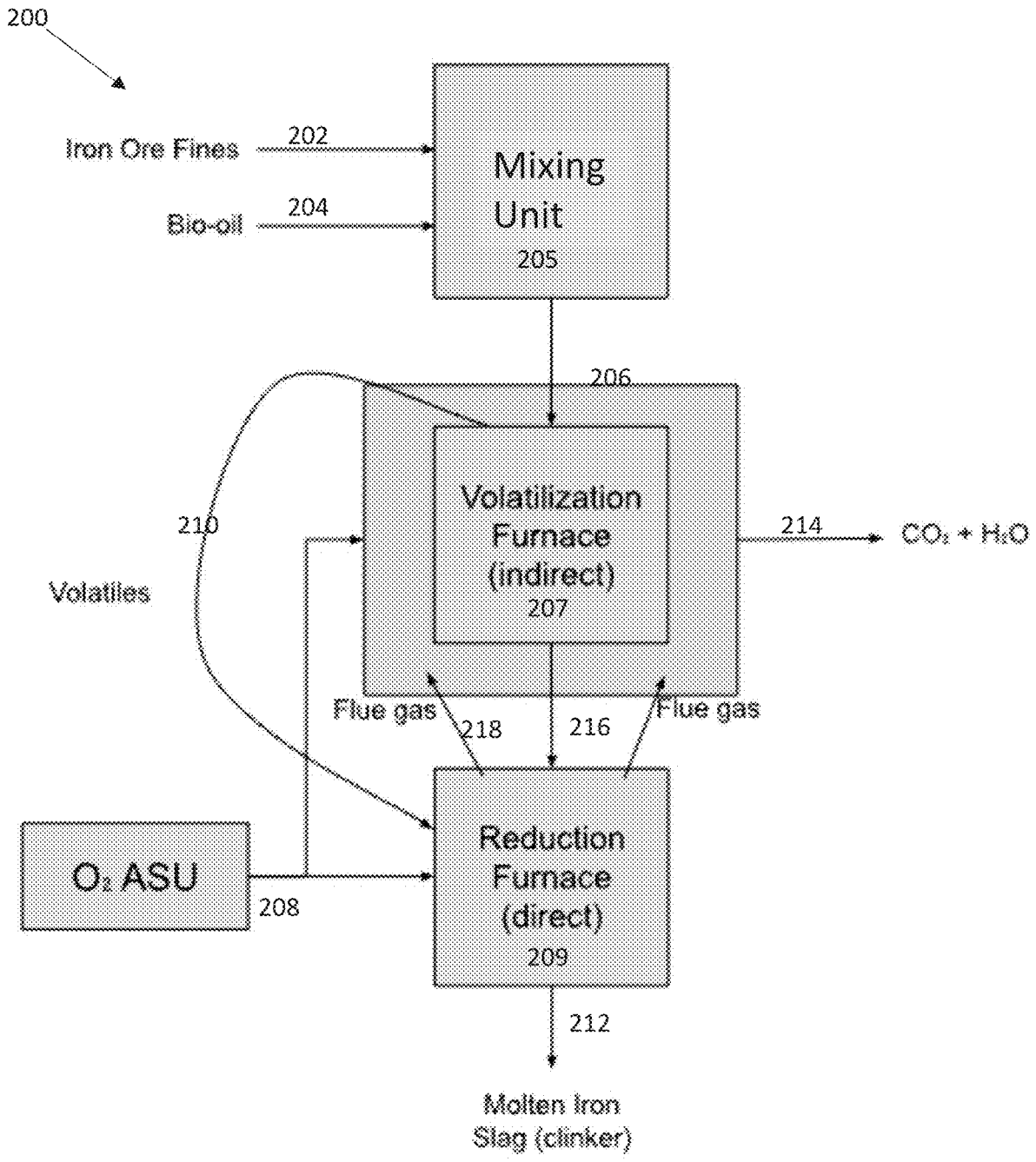
FIG. 2 depicts a flow diagram for another exemplary process for producing iron through self-reduction using bio-oil, according to an embodiment disclosed herein.

FIG. 2 depicts another exemplary process 200 for producing iron via self-reduction using bio-oil 204 and iron ore fines 202. In some embodiments, the feed furnace mixture 206 is produced in a manner similar to the feed furnace mixture 106 described in FIG. 1. In some embodiments, the feed furnace mixture 206 is then fed to a volatilization furnace 207 where the volatile gases are released by heating the furnace mixture (similar to FIG. 1), where at least some self-reduction of the iron ore may occur. In some embodiments, however, the volatile gases 210 are captured and fed to a reduction furnace 209. The feed furnace mixture 206, reduced iron ore, and/or molten iron can also be fed to said reduction furnace 209, such that the volatile gases can be burned to provide heat for direct reduction of the remaining iron ore. In some embodiments, a feed stream 216 to the reduction furnace 209 from the volatilization furnace 207 is the same as or substantially similar to the feed furnace mixture 206 (e.g., with no reduction of iron ore occurring in the volatilization furnace 207). In some embodiments, the feed stream 216 to the reduction furnace from the volatilization furnace includes about 0%, 10%, 25%, 50%, 75% or 95% (by volume or mass) of reduced iron ore (e.g., at least partially reduced iron ore).

In some embodiments, oxygen, air, or oxygen enriched air 208 is provided to the reduction furnace 209 and/or volatilization furnace 207 to assist with combustion of the volatile gases and/or other fuel sources. In some embodiments, the flue gas 218 generated from the reduction furnace 209 is fed to the volatilization furnace 207 as heat input. In some embodiments, the flue gas 218 includes $CO_2$ and $H_2O$ (e.g., produced via reduction of the iron ore), which may then be released 214 from the volatilization furnace.

In some embodiments, instead of molten iron slag being produced, stream 212 outputs direct reduced iron (e.g. solid iron product, direct reduced sponge iron, etc.).

In some embodiments, the reduction furnace 209 outputs molten iron 212 as described above in FIG. 1. In some embodiments, the process 100, 200 in FIG. 1 and/or FIG. 2 is performed as a batch operation or as a continuous operation.

Example 1

Figure 3:
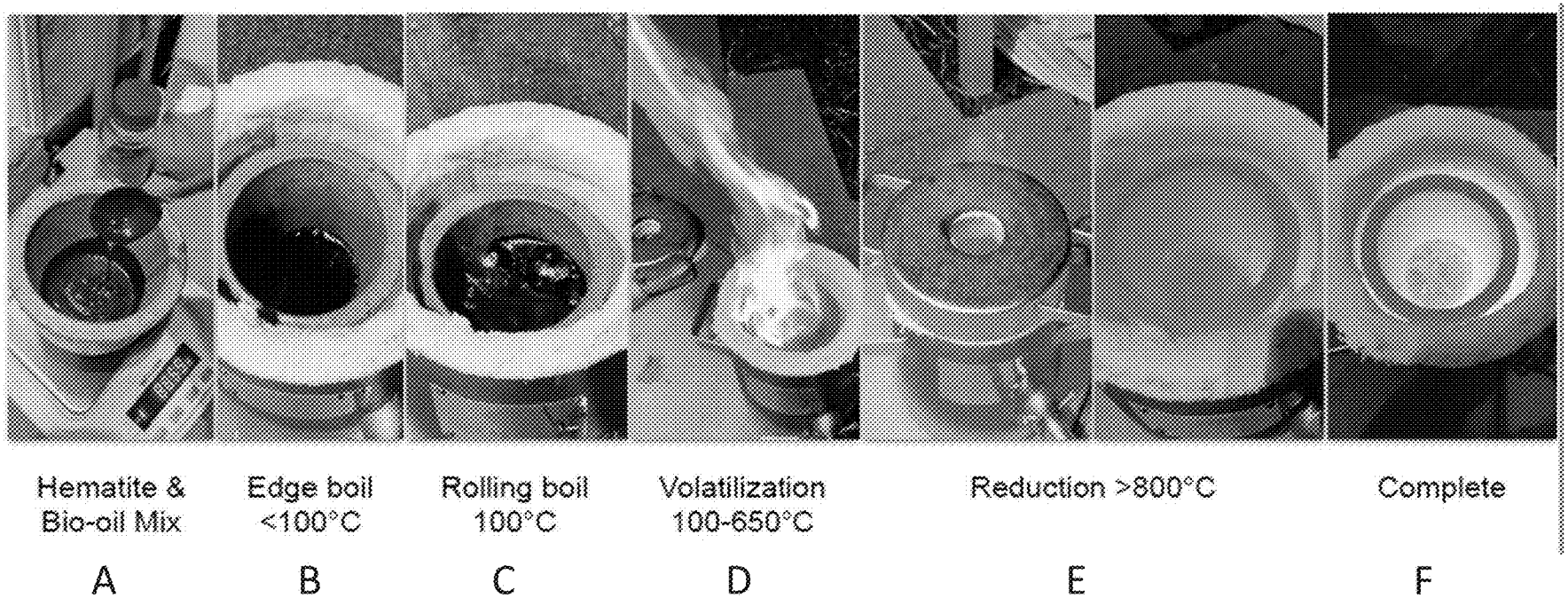
FIG. 3 depicts an exemplary batch process for producing iron through self-reduction using bio-oil, according to an embodiment disclosed herein.
Figure 4:
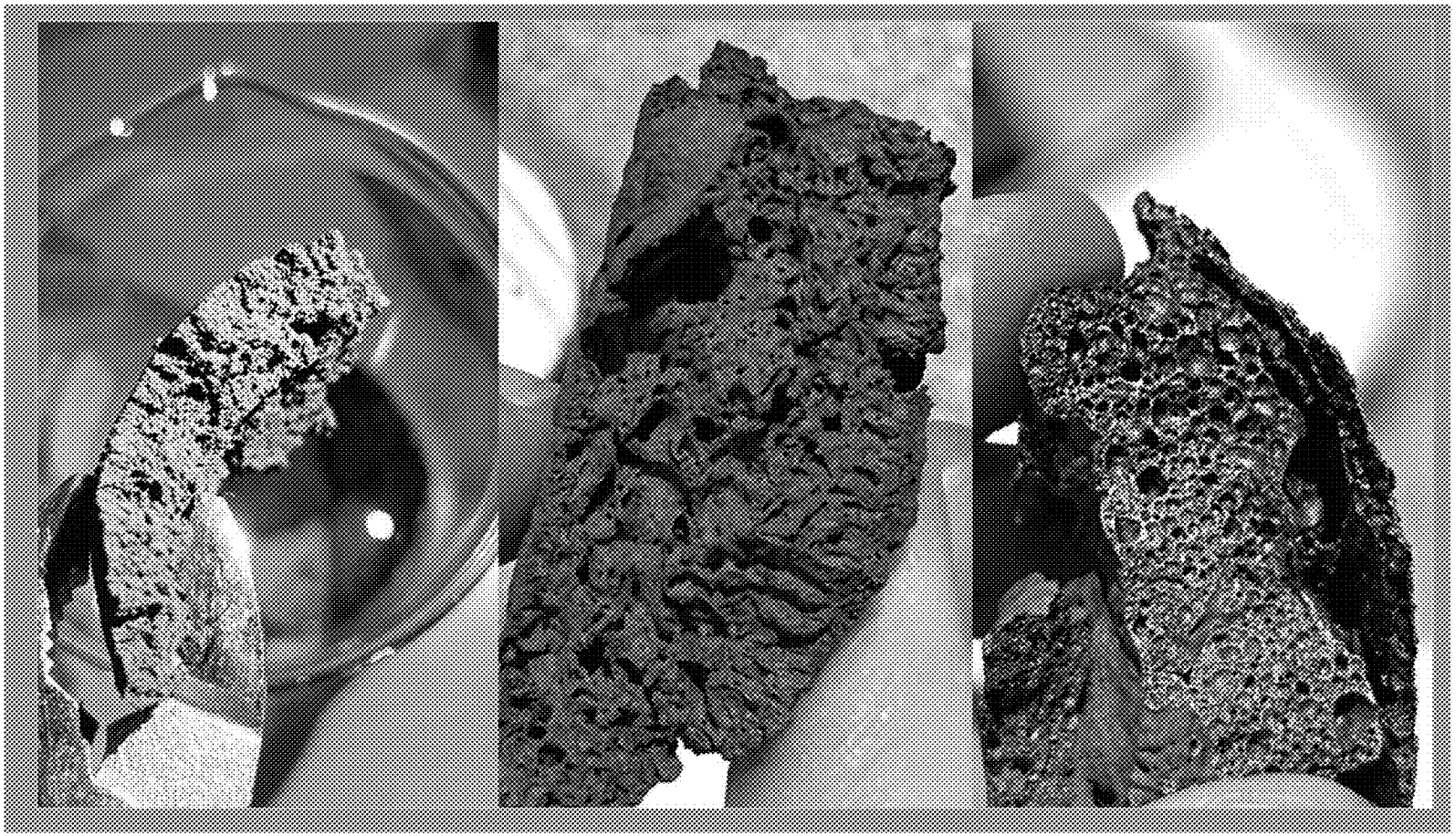
FIG. 4 depicts the produced iron from the batch process in FIG. 3.

FIG. 3 includes photographs depicting an exemplary batch process for producing iron via self-reduction using bio-oil. Iron ore was provided using hematite and mixed with bio-oil in a heating pot (A), so as to form a furnace mixture. The heating pot was heated (B, C), wherein volatilization was observed at temperatures from about 100° C. to about 650° C. (D). Reduction of the iron ore occurred at temperatures of at least about 800° C. (E, F). The cooled iron produced in this example is shown in FIG. 4.

Example 2

Figure 5:
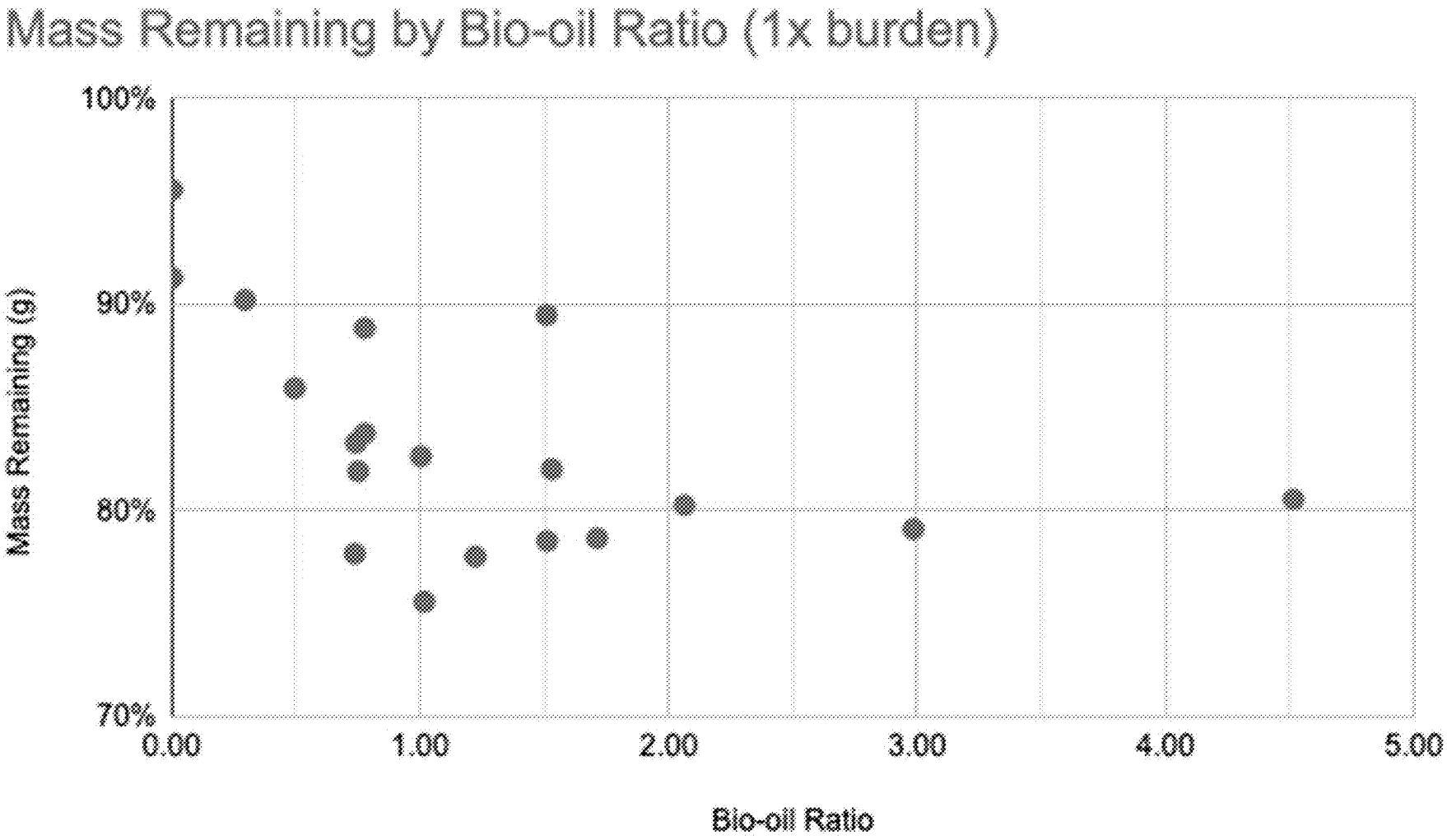
FIG. 5 depicts an exemplary comparison of mass remaining of an iron ore after reduction with varying amounts of bio-oil.
Figure 6:
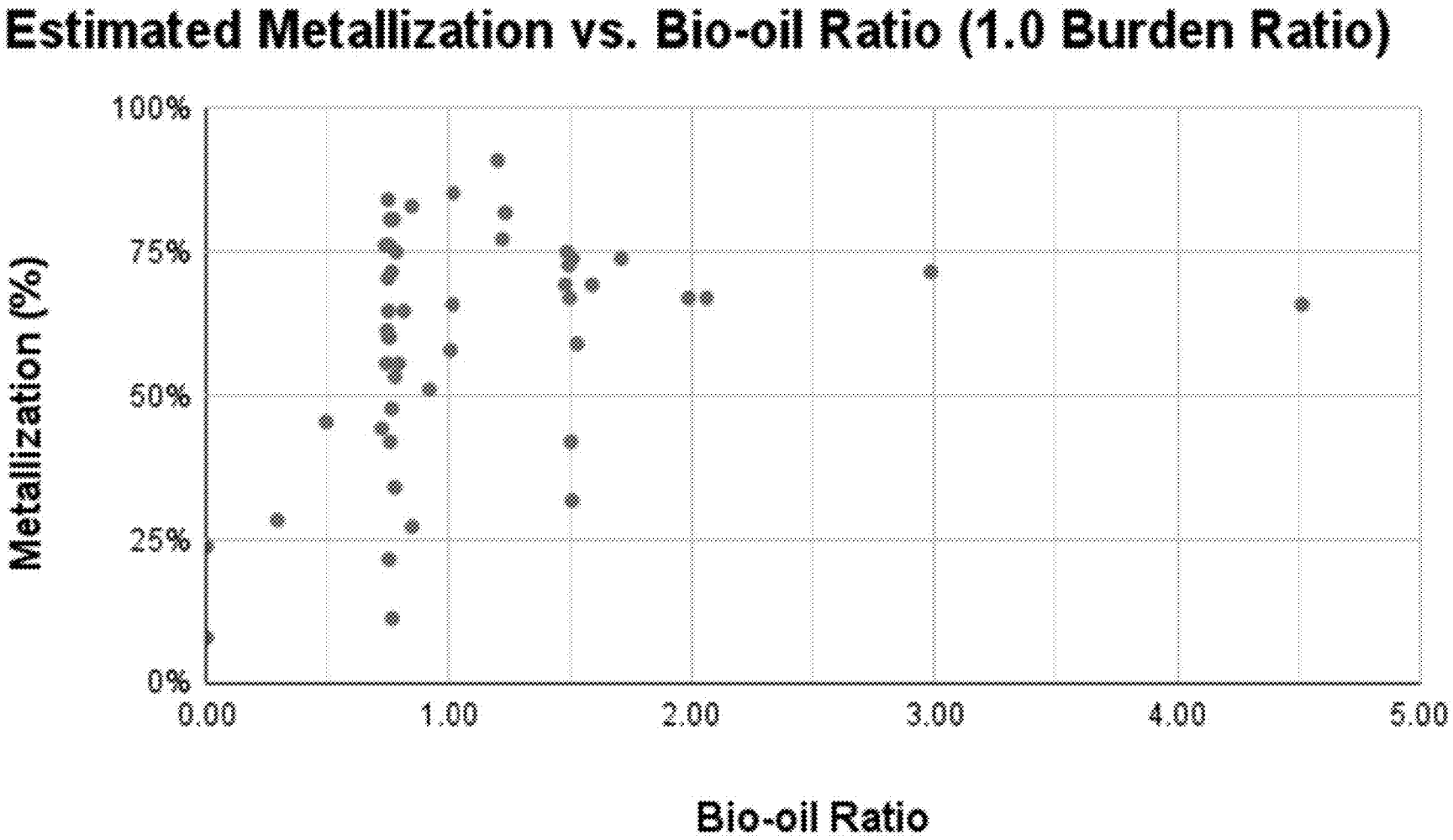
FIG. 6 depicts an exemplary comparison of metallization of iron after reduction with varying amounts of bio-oil.

FIGS. 5 and 6 depict varying characteristics of the iron produced by self-reduction with bio-oil as a function of the mass ratio of bio-oil to iron used in the reduction process. As depicted in FIG. 5, as the amount of bio-oil by mass increased in the furnace mixture to about 1.0, the mass remaining of the iron approached 70%, thereby indicating that a significant amount of the oxygen has been removed from the iron ore (total elemental iron is estimated to be about 70% of the mass of iron oxide). Furthermore, as depicted in FIG. 6, as the bio-oil mass ratio to iron ore increased in the furnace mixture to about 1.0, the metallization of the product (reduced iron) increased, becoming greater than 70% (e.g., more than 70% of the iron mass of the product was metallic iron rather than iron bound to oxygen). As depicted in FIGS. 5 and 6 however, the mass reduction and metallization of the reduced iron appears to somewhat plateau at a bio-oil mass ratio of about 1.0, wherein an increased amount of bio-oil did not yield further reduction in mass nor increase in metallization. In some cases, a bio-oil mass ratio of about 1.0 would maximize the reduction of iron ore to iron.

Example 3

The data shown in FIGS. 5 and 6 correlate with a 1× burden height, which refers to the height of the bio-oil+iron fine slurry (e.g., furnace mixture) in the furnace (e.g., furnace 106, volatilization furnace 107). In a further example, the burden height can be varied in comparison with the 1× burden height (which is a reference height). In some examples, a change in the burden height can impact the reduction of iron ore to iron, which may be characterized via the change in metallization and/or mass reduction. For example, increasing the height of the furnace mixture in the furnace may yield a higher reduction of iron ore to iron.

Example 4

Figure 7:
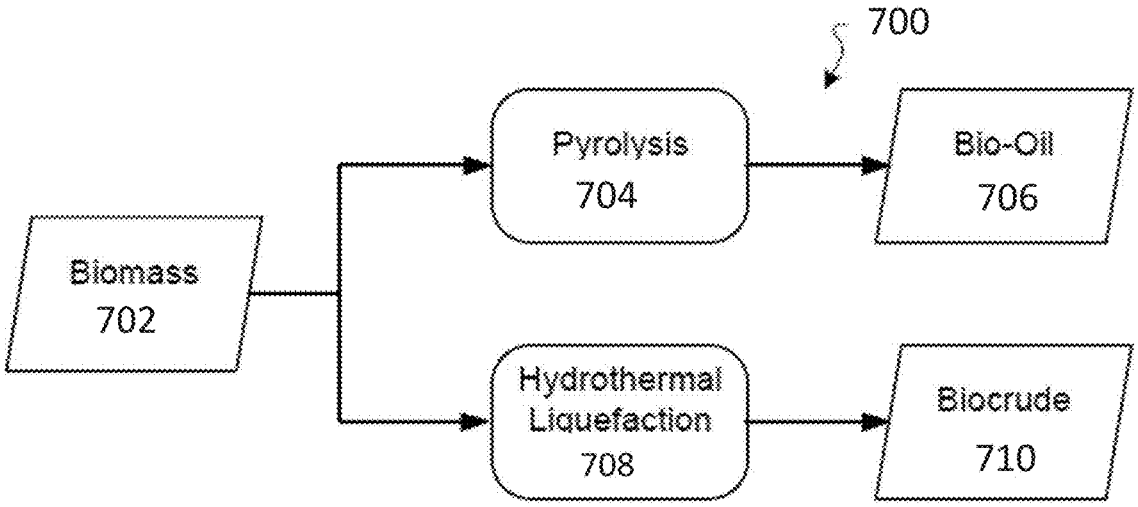
FIG. 7 is a schematic diagram of a system for preparing a carbon-containing liquid from a biomass, in accordance with certain embodiments.

FIG. 7 is a schematic diagram of a system 700 for preparing a carbon-containing liquid from a biomass 702, in accordance with certain embodiments. In one example, a pyrolysis process 704 is used to produce a bio-oil 706 from the biomass 702. The pyrolysis process 704 can use a variety of pyrolysis techniques to produce bio-oil and/or biochar (e.g., at a range of 400° C. to 800° C.), with a range of heating rates and residence times from less than a second to many minutes. In some examples, a highest yield of bio-oil can be achieved using a fast or flash pyrolysis technique. The fast pyrolysis process can involve heating the feedstock biomass 702 to roughly 500° C. at an extremely high heating rate (e.g., from about 20° C. to about 500° C. in less than 1 second, 10 seconds, or 1 minute). Alternatively or additionally, a slow or intermediate pyrolysis process can be used. Compared to fast pyrolysis, the slow or intermediate pyrolysis process can have a slower heating rate and/or a wider temperature range (e.g., for a final temperature) and, in some examples, can result in a lower yield of bio-oil. The resulting bio-oil 706 can have properties similar to those of crude oil removed from geological formations after many millions of years. The pyrolysis process 704 can utilize fast pyrolysis equipment and/or systems used by and/or available from ENSYN or ABRI-TECH in Canada, BTG in the Netherlands, or IOWA STATE UNIVERSITY, CHARM INDUSTRIAL, FRONTLINE BIOENERGY, or MAINSTREAM ENGINEERING in the United States. Methods of performing pyrolysis of biomass are described in U.S. Pat. No. 10,457,882, issued Oct. 29, 2019, and in U.S. Pat. No. 10,851,037, issued Dec. 1, 2020, the entire disclosures of which are incorporated by reference herein.

In another example, a hydrothermal liquefaction process 708 is used to produce a biocrude 710 from the biomass 702. The hydrothermal liquefaction process 708 can be or include a thermochemical conversion process that converts the biomass 702 and water into the biocrude 710 (an oil component), an aqueous byproduct, a solid hydrochar byproduct, and a syngas mixture that is typically at least 90% $CO_2$. The biomass 702 can be a ground biomass with a variety of moisture contents. The hydrothermal liquefaction process 708 can be performed in a reactor using sub-critical or supercritical water, for example, at 300° C. to 350° C. and about 3000 psi. The residence time in the reactor is typically on the order of minutes. The biocrude 710 and the byproducts can be upgraded into sustainable jet, road, or marine fuels; however, this can be cost-prohibitive depending on the quality of the biocrude 710. The hydrothermal liquefaction process 708 can utilize hydrothermal liquefaction equipment and/or systems used by and/or available from PACIFIC NORTHWEST NATIONAL LABORATORY or GENIFUEL in the United States, STEEPER ENERGY in Denmark and Canada, LICELLA in Australia, or ALTACA ENERGY in Turkey.

Example 5

Figure 8:
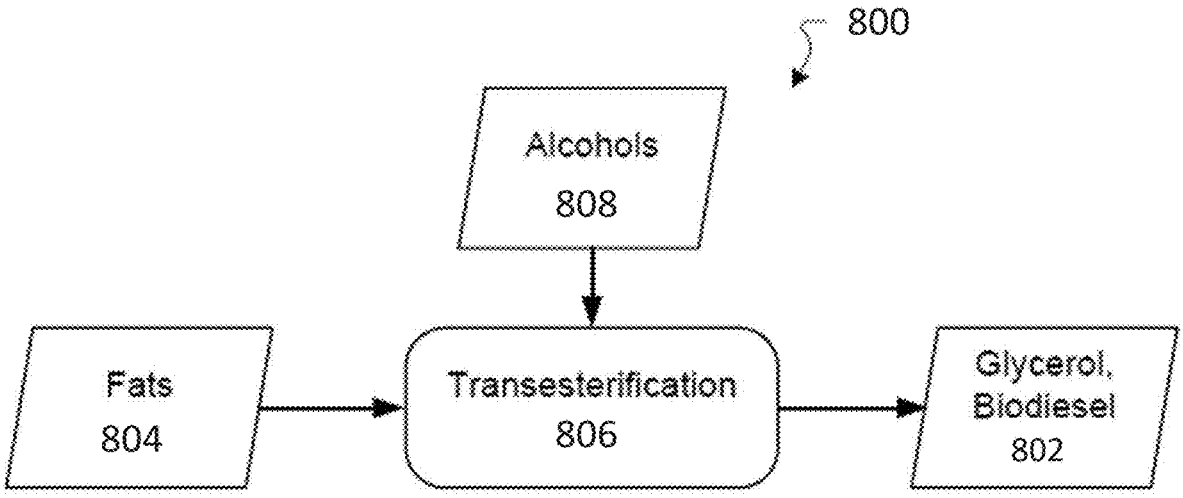
FIG. 8 is a schematic diagram of a system for producing biodiesel and glycerol from one or more fats and alcohols in a transesterification process, in accordance with certain embodiments.

Referring to FIG. 8, in some examples, a system 800 can be used to produce biodiesel and glycerol 802 (or other carbon-containing liquids) from one or more fats 804 in a transesterification process 806. The transesterification process 806 can involve a reaction in which the fats 804 react with one or more alcohols 808 in the presence of a catalyst to produce the biodiesel and glycerol 802. The fats 804 can be derived from agricultural waste, vegetable oils, used cooking oils, or from animal origin. In some examples, glycerol can be refined further to produce food grade consumer products, incinerated, or provided to cows or other livestock as a feed supplement. The transesterification process 806 can utilize equipment and/or systems used by and/or available from CARGILL Inc. and/or AG PROCESSING Inc., which are both based in the United States.

Example 6

Figure 9:
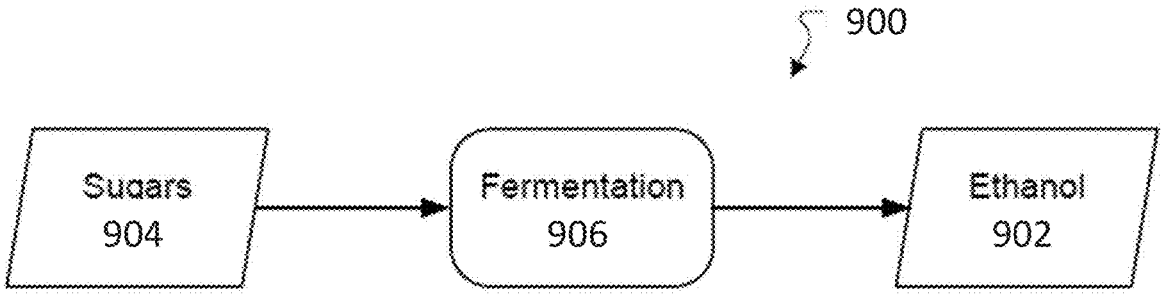
FIG. 9 is a schematic diagram of a system for producing ethanol from one or more sugars in a fermentation process, in accordance with certain embodiments.

Referring to FIG. 9, in some examples, a system 900 can be used to produce ethanol 902 (or other alcohols or carbon-containing liquids) from one or more sugars 904 (e.g., cellulosic biomass-derived sugars, direct biogenic sugars, or other carbohydrates) in a fermentation process 906 in which bacteria consume the sugars 904 and excrete the ethanol 902 in dilute form (e.g., an ethanol and water mixture). The ethanol 902 can be distilled and dehydrated to lower water concentrations (e.g., about 0 to 5% water); however, in a typical example, the distillation and/or dehydration steps can be reduced or eliminated to reduce production costs. In some instances, for example, the ethanol 902 can have an ethanol concentration that is less than or equal to 24% (e.g., more than 76% water). Solutions having ethanol concentrations greater than 24% may be considered hazardous waste. The fermentation process 906 can utilize equipment and/or systems used by and/or available from ARCHER DANIEL MIDLAND Co., CARGILL Inc., or MARQUIS ENERGY LLC, each of which is based in the United States.

Example 7

Figure 10:
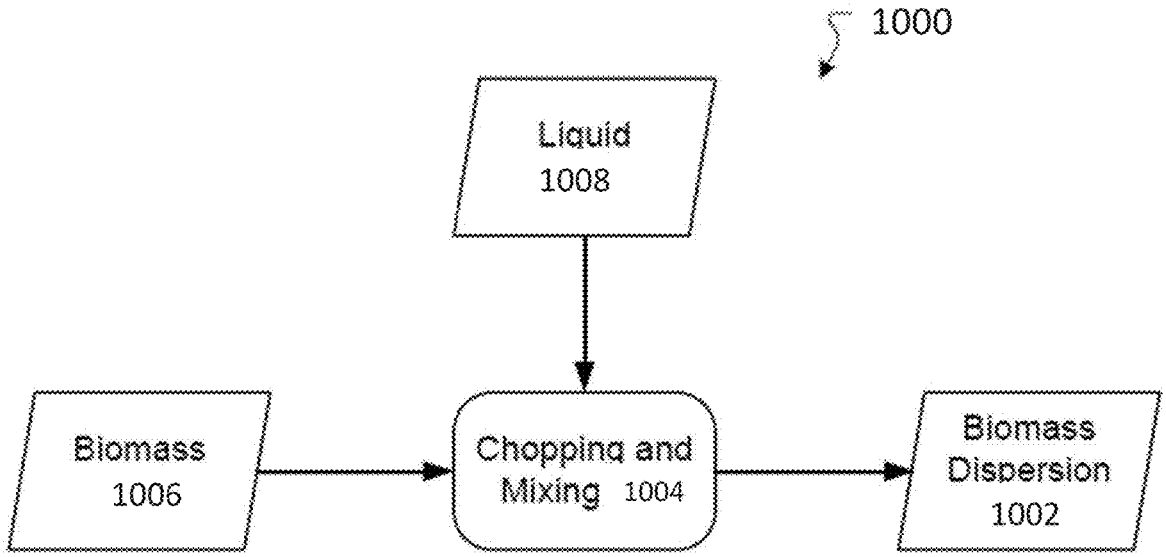
FIG. 10 is a schematic diagram of a system for producing a dispersion of biomass particles and/or biochar particles in a liquid, in accordance with certain embodiments.

Referring to FIG. 10, in certain examples, a system 1000 can be used to produce a carbon-containing liquid that is or includes a biomass dispersion 1002 in which biomass particles and/or particles of biochar (e.g., produced from pyrolysis or hydrothermal liquefaction) are mixed or suspended in a liquid. A chopping and mixing process 1004 can be used to chop a biomass 1006 and/or biochar into small particles and then mix the particles with a liquid 1008 to form the biomass dispersion 1002. The chopping and mixing process 1004 can utilize one or more mechanical devices to form the particles, such as a chopper, a shredder, and/or a grinder. The particle sizes (e.g., diameters) can be, for example, less than about 200 mm, less than about 50 mm, less than about 2 mm, or less than about 0.1 mm, on average or maximum. In general, smaller particle sizes can result in a biomass dispersion 1002 that is easier to pump and/or less likely to clog pumping equipment.

In general, the chopping and mixing process 1004 can form biomass particles without altering a chemical composition of the original biomass 1006. For example, the biomass particles can have the same or similar chemical composition as the original biomass 1006. A variety of mixing devices (e.g., including tanks and stirring devices) can be used to mix the particles with the liquid 1008, which can be or include, for example, water, a carbon-containing liquid (e.g., bio-oil or glycerol), and/or other suitable liquid. One or more surfactants can be added to promote dispersion stability. Additionally or alternatively, a biocide can be added to prevent or limit microbial growth. In some examples, the biomass dispersion 452 can include particles of biochar in addition to or instead of the biomass particles.

Example 8

Figure 11:
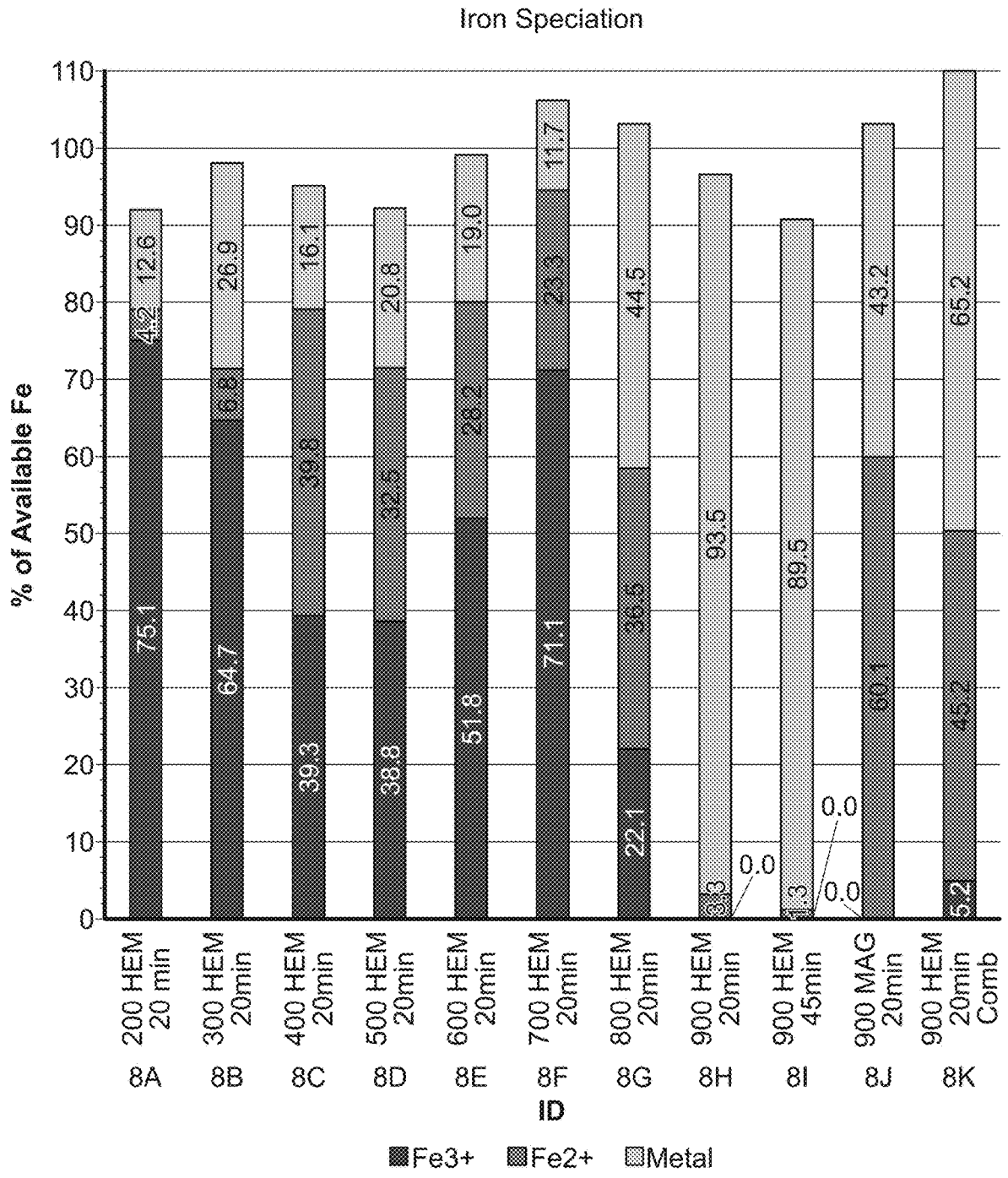
FIG. 11 depicts an exemplary comparison of metallization of iron oxide for various self-reduction reaction temperatures, in accordance with certain embodiments.

FIG. 11 depicts observations from a series of reduction experiments 8A through 8K that were carried out at temperature intervals of 100° C., from 200° C. to 900° C. Experiments 8A through 8I and 8K were performed using hematite mixed with bio-oil, while experiment 8J was performed using magnetite mixed with bio-oil. Experiment 8K utilized a sample size that was two times (2×) larger (40 g) than the sample size used for experiments 8A through 8J (20 g). All the experiments were performed using a reaction time of 20 minutes, with the exception of experiment 8I, which used a reaction time of 45 minutes. The amounts of iron in the form of $Fe^{3+}$, $Fe^{2+}$, and metallized iron ($Fe^{0}$) are depicted.

As the results indicate, iron metallization was observed to be a strong function of temperature, showing maximum reduction at 900° C. for a 20-minute holding time, in experiment 8H. This indicates a very fast reaction using bio-oil, at relatively low temperatures for an ironmaking process. Hematite achieved >90% metallization at 900° C. while magnetite ore did not (compare experiments 8H and 8J). These observations indicate that gas-based reduction of FeO via CO is present, as an initially hematite ore will have a more porous structure than a natural magnetite ore during reaction, allowing for rapid iron oxide reduction. Further, a small improvement in metallization was observed when increasing the holding time for the reaction from 20 minutes to 45 minutes, suggesting that the reaction extent can be controlled effectively based on residence time at 900° C. (compare experiments 8H and 8I). These results suggest fast reduction kinetics, such that throughput of material through the hot zone of a reactor may be exemplified by a reduction time of 0-100 minutes, such as 0-20 minutes, 10-30 minutes, 20-40 minutes, and/or 30-50 minutes.

Figure 12:
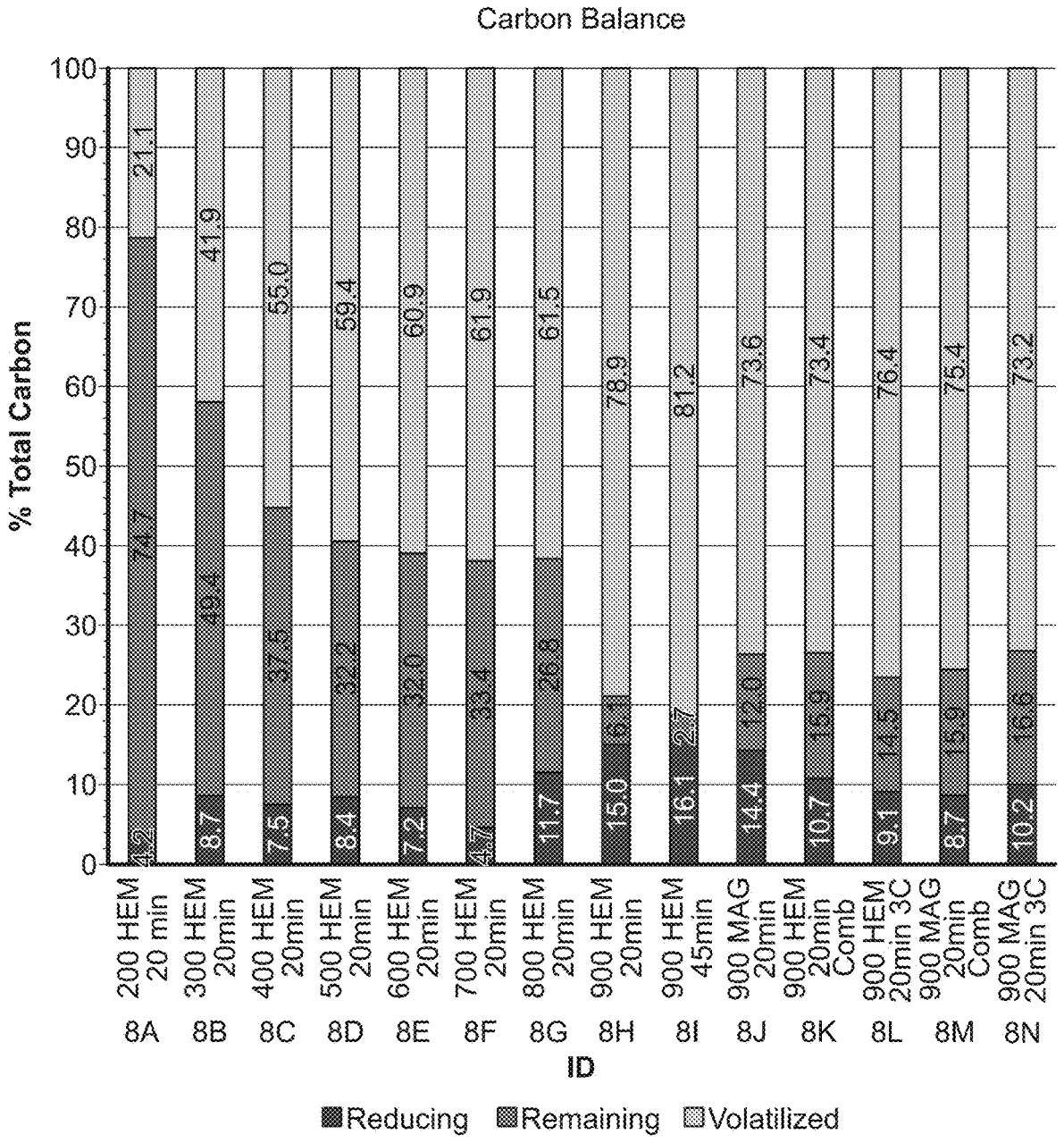
FIG. 12 depicts an exemplary comparison of carbon evaluation for various self-reduction reaction temperatures, in accordance with certain embodiments.

Further, the increased metallization at higher temperatures suggests that a Boudouard reaction accelerates the rate of reduction by converting $CO_2$ to CO via carbon, according to the paired reactions $FeO+CO \approx Fe+CO_2$, and $CO_2+C \approx 2CO$. FIG. 12 depicts the relative proportion of carbon, specifically in the form of $CO_2$ ("reducing"), C ("remaining carbon"), and CO or volatiles ("volatized carbon") after the reduction experiments from FIG. 11 and three additional reduction experiments 8L, 8M, and 8N, as described herein. The observed carbon balance from the reduction experiments support the need for the Boudouard reaction to occur, and that reaction temperatures >900° C. (such as 900-950° C., 950-1000° C., 1000-1050° C., or 1050-1100° C.) may be required for high levels of iron oxide reduction. The residual (remaining) carbon in samples is observed (in FIG. 12) to decrease when successful reduction of iron occurs.

Furthermore, experiments 8K through 8N correspond to feed mixtures of bio-oil and iron oxide (e.g., hematite, magnetite) having larger sample sizes (40 g), compared to experiments 8A through 8J (20 g). The samples used for experiments 8K through 8N resulted in a lower quality mixture (e.g., lower dispersion stability) and were observed to have a lower reduction rate, compared to corresponding experiments with smaller sample sizes and better mixing. Maintaining a stable suspension of iron oxide particles in the bio-oil was more challenging for larger samples, thus experiments 8K through 8N showed a phase separation of solid iron oxide from bio-oil, resulting in poorly mixed conditions. Heavier iron oxide settled to the bottom, while less dense bio-oil floated on top and devolatilized absent of iron oxide to reduce. In experiment 8H, for example, 6.1% carbon remained at 900° C. after 20 minutes with hematite, while in corresponding experiment 8K 15.9% carbon remained at 900° C. after 20 minutes, with the larger sample size. In experiment 8L, 14.5% carbon remained at 900° C. after 20 minutes with poor mixing of hematite. Accordingly, these results suggest that poor mixing of the bio-oil and iron oxide can lead to inadequate utilization of the carbon and poor reduction. This indicates that effective use of gases, via close proximity of carbonaceous material to the iron oxide particles, is an important aspect of the mechanism for self-reduction. For example, it can be desirable for any gases (e.g., $H_2$ or CO) produced by heating the bio-oil (or other bio-based reducing agent) to come into contact with the iron oxide particles, and such contact can be achieved with proper mixing and/or a stable suspension. In some examples, smaller volumes, smaller iron ore particle sizes (e.g., use of iron ore concentrate), use of effective mixing techniques before the furnace (e.g., agitation with a mixer or bubbles), use of stabilizers, and/or use of rapid heating can help maintain a stable suspension during the reduction process. In certain examples, optimal mixing and/or suspension stability can be achieved by maximizing the mixing between the iron oxide and bio-oil (e.g., prior to the furnace) followed by rapid heating of the mixture, to achieve self-reduction before separation of the mixture occurs.

All publications, patents, patent applications and other documents cited in this application are hereby incorporated by reference herein in their entireties for all purposes to the same extent as if each individual publication, patent, patent application or other document were individually indicated to be incorporated by reference for all purposes. While various specific embodiments have been illustrated and described, the above specification is not restrictive. It will be appreciated that various changes can be made without departing from the spirit and scope of the present disclosure(s). Many variations will become apparent to those skilled in the art upon review of this specification.

The invention claimed is:

1. A process for producing a material comprising iron, the process comprising:

providing a reducing agent comprising bio-oil;

providing an iron ore feedstock comprising iron oxide;

mixing the bio based liquid reducing agent with the iron ore feedstock in a mixing unit to form a mixture; and heating the mixture in a furnace to reduce the iron oxide and produce the material comprising iron.

2. The process of claim 1, wherein the iron ore feedstock comprises at least one of iron ore fines or iron ore concentrate.

3. The process of claim 1, wherein the mixture is heated to at least about 900° C.

4. The process of claim 1, wherein the mixture comprises a mass ratio of the reducing agent to the iron ore feedstock mass ratie from about 0.5:1 to about 1.5:1.

5. The process of claim 1, wherein the reducing agent further comprises one or more of glycerol, biodiesel, ethanol, other alcohols, used cooking oils, vegetable oil, plant-based oils, solutions containing microbes or algae, biocrude, biochar, or biocrude byproducts.

6. The process of claim 1, wherein the material comprising iron comprises one or more of pure iron, direct reduced iron, hot briquetted iron, pig iron, molten iron, hot metal, sponge iron, or an iron rich metal.

7. The process of claim 1, wherein the iron oxide comprises one or more of hematite, magnetite, or wustite.

8. The process of claim 1, wherein the iron ore feedstock comprises iron ore particle sizes from about 0.1 mm to about 1 cm.

9. The process of claim 1, wherein the produced material comprising iron comprises from about 70% to about 100% metallization of iron from the iron oxide.

10. The process of claim 1, further comprising adding flux to the mixture to help separate one or more impurities therefrom.

11. The process of claim 10, wherein the flux is alkaline or comprises alkaline components that bond with one or more of acidic sulfur or silicate components.

12. The process of claim 1, wherein the furnace comprises a volatilization furnace and a reduction furnace, and wherein heating the mixture comprises i) heating the mixture in the volatilization furnace to release volatile gases, thereby producing a second mixture, and ii) heating the second mixture in the reduction furnace to produce the material comprising iron.

13. A system for producing a material comprising iron, the system comprising:

a. a source of a reducing agent comprising bio-oil;

b. an iron ore feedstock comprising iron oxide;

c. a mixing unit configured to mix the reducing agent and the iron ore feedstock to form a mixture; and d. a furnace configured to heat the mixture to reduce the iron oxide and form the material comprising iron.

14. The system of claim 13, wherein the iron ore feedstock comprises at least one of iron ore fines or iron ore concentrate.

15. The system of claim 13, wherein the furnace is configured to heat the mixture to at least about 900° C.

16. The system of claim 13, wherein the mixing unit is in fluid communication with the furnace, to enable the mixture to be transferred from the mixing unit to the furnace.

17. The system of claim 13, wherein the mixing unit is disposed within the furnace, to mix the reducing agent and iron ore feedstock therein.

18. The system of claim 13, wherein the mixing unit comprises a shaft and one or more blades at a distal portion thereof, and wherein the one or more blades are configured to rotate about a longitudinal axis of the shaft.

19. The system of claim 18, wherein the shaft is operatively coupled to a motor configured to rotate the shaft.

20. The system of claim 13, further comprising one or more of an amine-based carbon capture system, pressure swing adsorption system, vacuum swing adsorption system, temperature swing adsorption system, gas separation membranes, or polymeric membranes, to capture and/or sequester carbon dioxide.

21. The system of claim 13, wherein the furnace comprises a volatilization furnace and a reduction furnace, the volatilization furnace configured to heat the mixture to release volatile gases and form a second mixture, the reduction furnace configured to receive and heat the second mixture to produce the material comprising iron.

22. The system of claim 13, wherein the reducing agent further comprises one or more of glycerol, biodiesel, ethanol, other alcohols, used cooking oils, vegetable oil, plant-based oils, solutions containing microbes or algae, biochar, biocrude, or biocrude byproducts.

23. The system of claim 13, wherein the bio-oil comprises a liquid formed at least partially from one or more of agricultural crops, algal biomass, municipal wastes, or agriculture and forestry by-products.

24. The system of claim 13, wherein the material comprising iron comprises one or more of pure iron, direct reduced iron, hot briquetted iron, pig iron, molten iron, hot metal, sponge iron, or an iron rich metal.

25. The system of claim 13, wherein the iron oxide comprises one or more of hematite, magnetite, or wustite.

26. The system of claim 13, wherein the iron ore feedstock comprises iron ore particle sizes from about 0.1 mm to about 1 cm.

27. The system of claim 13, wherein the produced material comprising iron comprises from about 70% to about 100% metallization of iron from the iron oxide.

28. The system of claim 13, wherein the mixture comprises a liquid, substantially liquid, or a slurry form.

29. The system of claim 13, wherein the mixture comprises a mass ratio of the reducing agent to the iron ore feedstock from about 0.5:1 to about 1.5:1.

30. The system of claim 13, wherein the reducing agent further comprises biochar.

* * * * *